US006578393B2

(12) United States Patent
Yarborought

(10) Patent No.: US 6,578,393 B2
(45) Date of Patent: Jun. 17, 2003

(54) SECURITY COVER FOR PADLOCK

(76) Inventor: Doyle Yarborought, 828 N. Broadway, Booneville, AR (US) 72927

( * ) Notice: Subject to any disclaimer, the term of this patent is extended or adjusted under 35 U.S.C. 154(b) by 0 days.

(21) Appl. No.: 09/802,721

(22) Filed: Mar. 12, 2001

(65) Prior Publication Data

US 2002/0124603 A1 Sep. 12, 2002

(51) Int. Cl.[7] ..... E05B 67/38

(52) U.S. Cl. ..... 70/56; 70/52; 70/53; 70/54; 70/55; 70/DIG. 43; 70/DIG. 56

(58) Field of Search ..... 70/52–56, DIG. 43, 70/DIG. 56

(56) References Cited

U.S. PATENT DOCUMENTS

| | | | | | |
|---|---|---|---|---|---|
| 2,584,575 | A | | 2/1952 | Goldwasser | |
| 3,559,429 | A | * | 2/1971 | Hermann | 70/85 |
| 3,718,014 | A | * | 2/1973 | Delgadillo | 70/56 |
| 3,736,016 | A | * | 5/1973 | Garvey et al. | 292/281 |
| 3,751,948 | A | | 8/1973 | Klein | |
| 3,916,654 | A | * | 11/1975 | Mudge, Jr. | 70/56 |
| 4,122,693 | A | | 10/1978 | Barr | |
| 4,157,653 | A | * | 6/1979 | Dohanyos | 70/417 |
| 4,286,445 | A | * | 9/1981 | Sills | 70/55 |
| 4,576,022 | A | * | 3/1986 | Gamble | 70/55 |
| 4,781,043 | A | | 11/1988 | Loeffler | |
| 4,879,889 | A | | 11/1989 | DeForrest | |
| 4,896,518 | A | | 1/1990 | Appelgren | |
| 4,915,257 | A | * | 4/1990 | Bailey | 221/48 |
| 4,972,689 | A | * | 11/1990 | Anderson | 70/56 |
| 5,146,771 | A | * | 9/1992 | Loughlin | 70/56 |
| 5,275,028 | A | * | 1/1994 | Giarrante | 70/56 |
| 5,477,710 | A | * | 12/1995 | Stefanutti | 70/56 |
| 5,743,118 | A | | 4/1998 | Anderson | |
| 5,761,935 | A | * | 6/1998 | Adelmeyer | 70/55 |
| 5,806,351 | A | * | 9/1998 | Learnahan | 70/56 |
| D408,265 | S | | 4/1999 | Bills | |
| 5,924,314 | A | | 7/1999 | Cernansky | |
| 6,010,166 | A | * | 1/2000 | Hamilton et al. | 292/282 |
| 6,351,975 | B1 | * | 3/2002 | Valdes | 70/56 |

* cited by examiner

*Primary Examiner*—Anthony Knight
*Assistant Examiner*—John B. Walsh
(74) *Attorney, Agent, or Firm*—Boyd D. Cox

(57) ABSTRACT

A security cover for a padlock used to lock a hasp or other similar structure comprises a housing having first, second and third openings. The openings provide limited access to the housing's interior region. When installed on a hasp, the shackle and a substantial portion of the hasp's eye extend through the second and third openings, respectively, and are contained within the housing for protection.

10 Claims, 5 Drawing Sheets

SECURITY COVER FOR PADLOCK

BACKGROUND

The present invention is directed to a security cover for a padlock that can releasably envelop and surround the padlock's shackle in order to deter tampering and/or unwanted removal of the padlock. When the padlock is used on a hasp, the security cover also substantially covers the eye to protect against vandalism to the hasp as well.

Padlocks are used extensively to provide a measure of security. However, the shackle of a padlock is generally exposed and can be vulnerable to being severed by conventional cutting tools such as metal cutting shears or bolt cutters.

Covers are available for padlocks that inhibit easy access to the shackle of the padlock. However, these covers are primarily for protecting the padlock against weather damage. Other known types of covers can inhibit tampering with the lock itself, but these covers leave portions of the padlock's shackle exposed thereby providing a means for vandals to access and cut the shackle.

When the padlock is used with a hasp, the eye of the hasp can be left exposed and is just as vulnerable as an uncovered padlock shackle can be to being severed or other vandalism. Many times, the hasp is not adequately protected by known lock covers to resist vandalism.

There is a need for a security cover for a padlock that deters easy access to the shackle with conventional metal cutting tools. In addition, there is a need for a security cover that also protects the eye of a hasp on which the padlock is mounted to deter cutting of the eye to remove the padlock.

SUMMARY

The security cover of the present invention comprises a housing having an interior region defined by a plurality of walls which include means for accessing the interior region.

The means for accessing the interior region includes first, second and third openings in the housing walls. The first opening in the wall provides access to the shackle in order for a user to apply a force against the shackle to close the padlock. The second opening is adapted for receiving the eye of a hasp into the housing's interior region. The third opening enables the padlock to be inserted into the housing to engage the padlock with the eye of the hasp.

It is an object of the present invention to provide a security cover for a padlock that houses the shackle of the padlock.

It is a further object of the present invention to provide a security cover for a padlock that deters vandalism of the padlock.

It is a further object of the present invention to provide a security cover for a padlock that substantially covers and protects the eye of a hasp on which the padlock and cover are installed.

It is a further object of the present invention to provide a security cover having an interior region that can completely encase the shackle of a padlock locked to a hasp.

It is a further object of the present invention to provide a security cover having an opening that allows limited access to the padlock shackle.

It is a further object of the present invention to provide a security cover for a padlock on a hasp that enables the body of the padlock to swing outside the housing when the padlock is unlocked.

BRIEF DESCRIPTION OF THE DRAWINGS

Reference is made to the accompanying drawings in which are shown illustrative embodiments of the invention and from which novel features and advantages will be apparent.

DETAILED DESCRIPTION

Figure 1:
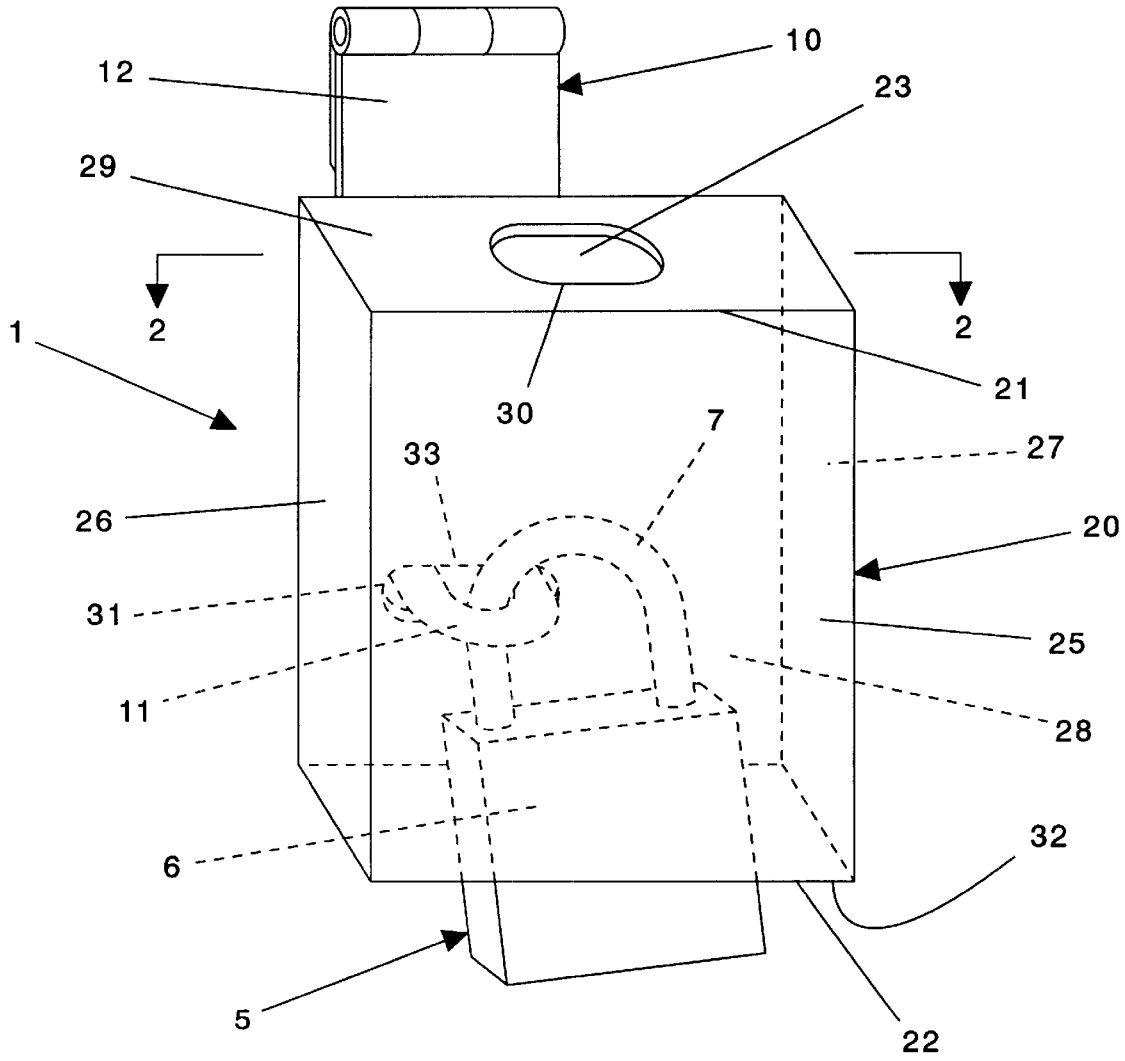
FIG. 1 is a top front perspective view of one preferred embodiment of the security cover of the present invention used in combination with a padlock and hasp.
Figure 4:
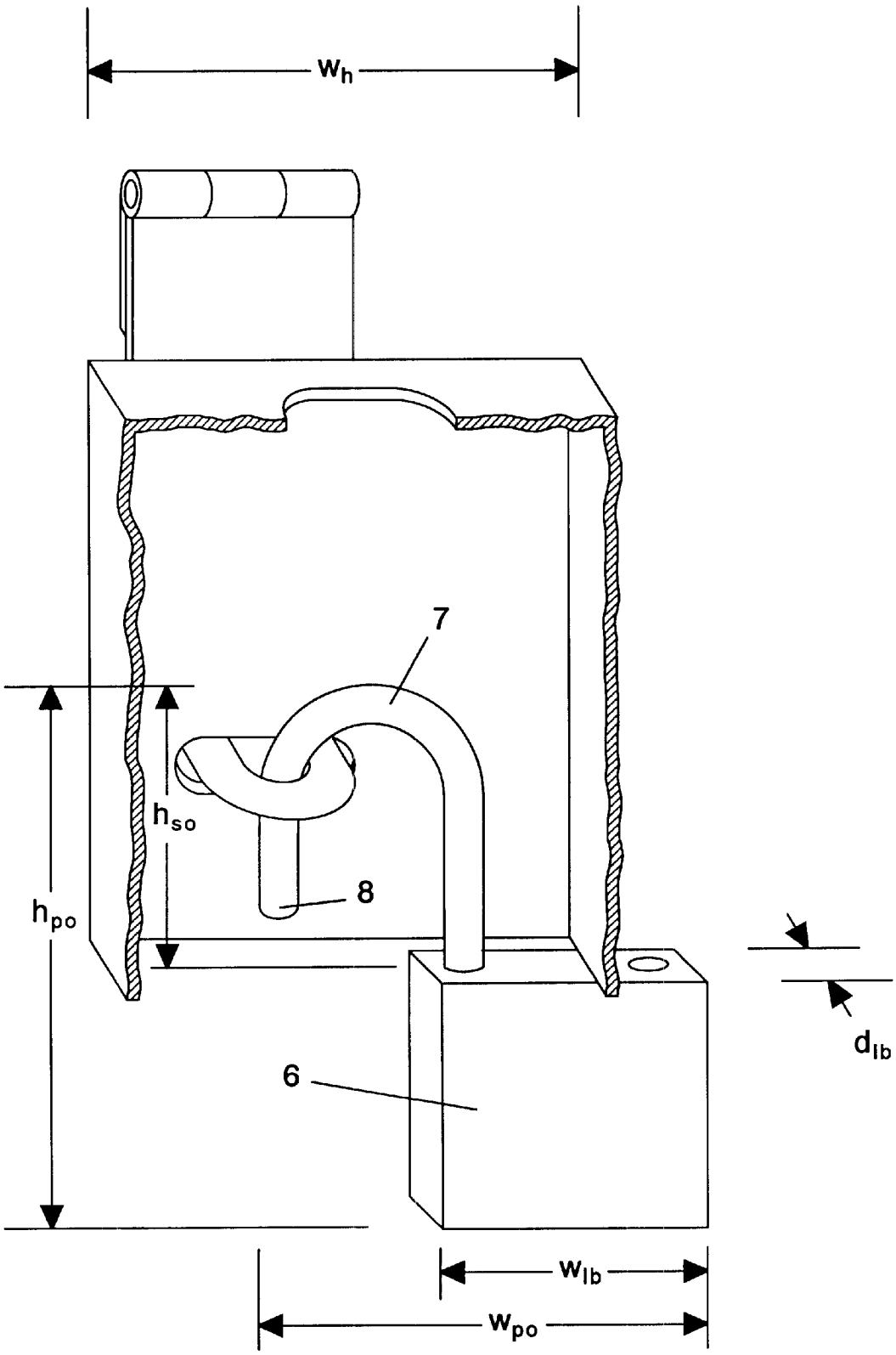
FIG. 4 is a partial front view of the security cover of FIG. 1 with the hasp and padlock in the unlocked/opened position.

Referring to FIG. 1, a conventional padlock (5) generally comprises a lock body (6) with a shackle (7). Typically such padlocks (5) can be characterized as including a locked position, an unlocked position and an unlocked/opened position. In the locked position, the shackle (7) is anchored at both ends within the lock body (6). In the unlocked position, the shackle (7) is released from the lock body (6), but is still disposed over the lock body (6). In the unlocked/opened position the shackle (7) is released from the lock body (6) and the lock body (6) is pivoted away from a free end (8) of the shackle (7) as shown in FIG. 4.

Padlocks are frequently used in combination with a hasp or similar fastener to secure a closure such as a door or gate. As shown by FIG. 1, the hasp (10) has an eye (11) and a securing piece (12). In use, the securing piece (12) fits over the eye (11); the shackle (7) is placed in the eye (11) and the padlock (5) is locked. The padlock (5) and hasp (10) cooperate to deter opening of an associated closure.

The security cover (1) comprises a housing (20) which has a first end (21) and a second end (22). The housing (20) is formed by a plurality of walls which define an interior region (23). In addition, the housing (20) includes means for accessing the interior region of the housing.

The plurality of walls includes a first side wall (25), a second side wall (26), a third side wall (27), a fourth side wall (28), and an end wall (29). The means for accessing the interior region includes first (30), second (31) and third (32) openings.

Figure 2:
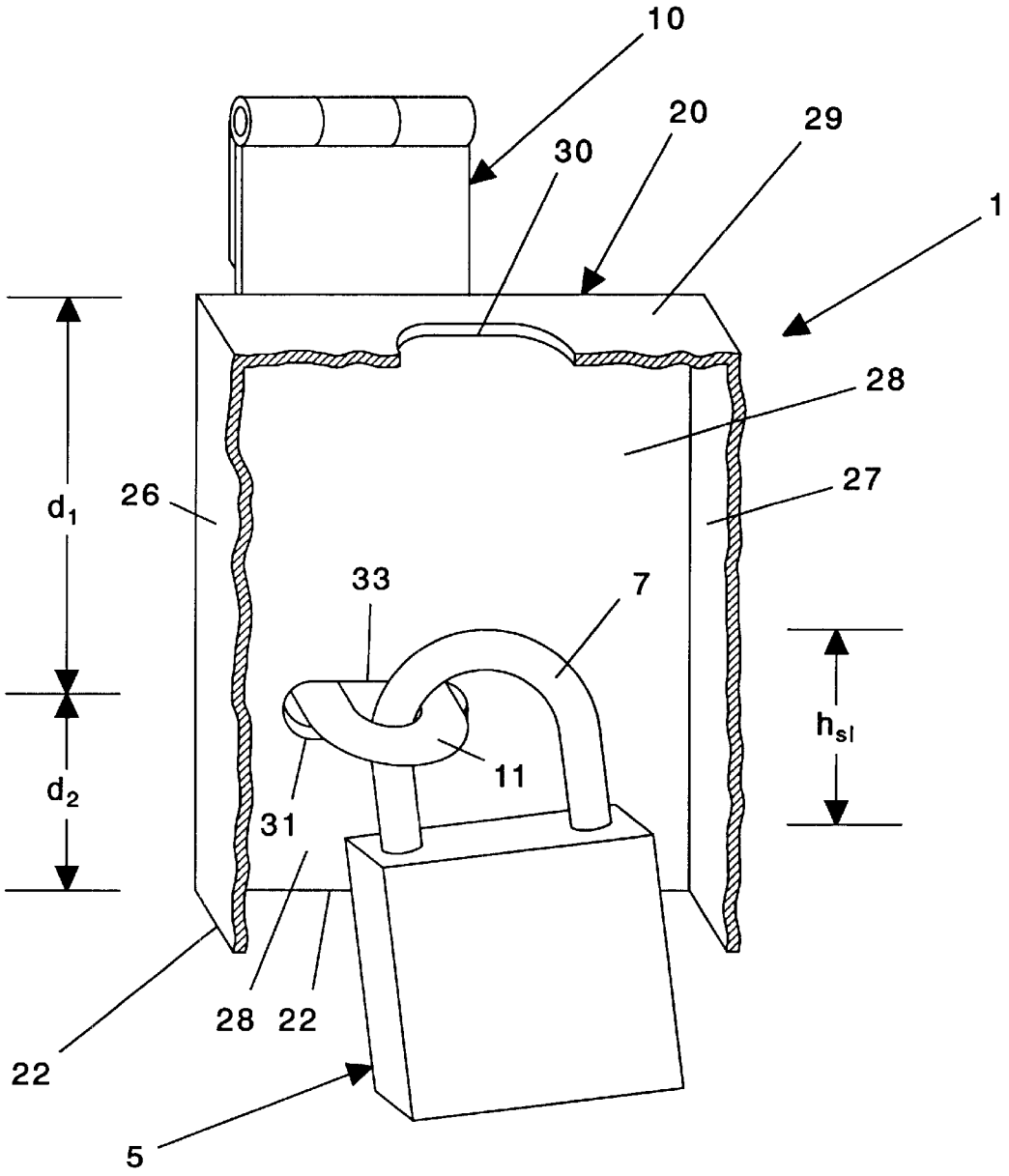
FIG. 2 is a partial front view of the security cover with padlock and hasp taken along line 2—2 in FIG. 1.
Figure 3:
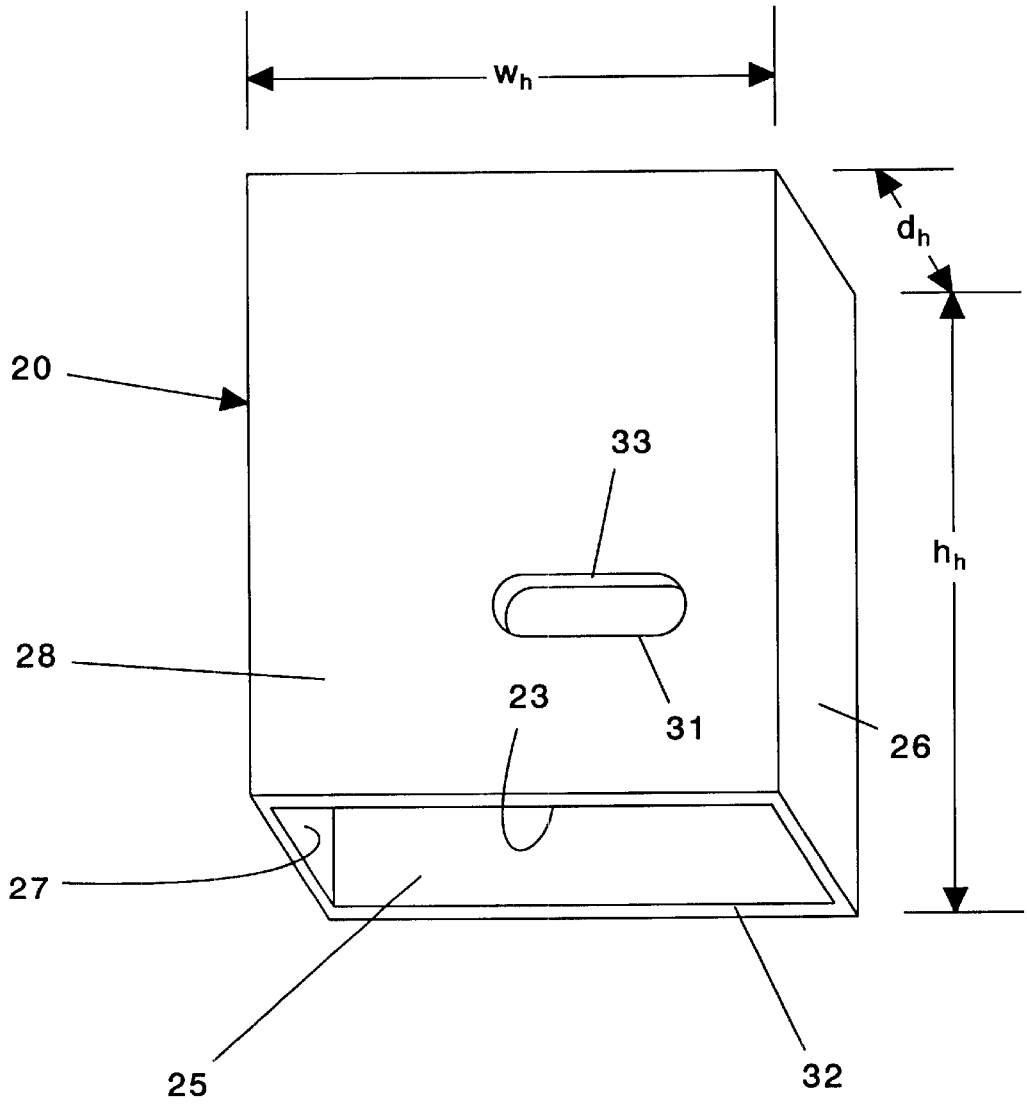
FIG. 3 is a lower rear perspective view of the security cover of FIG. 1.

In the preferred embodiment of FIGS. 1–3, the housing (20) and its interior region (23) are similarly shaped with rectangular profiles. Likewise, each of the walls (25–29) of the housing (20) are rectangular in shape.

In this preferred embodiment, the second opening (31) comprises a slot having an oblong shape with rounded ends which conforms to the shape of the eye (11). However, the second opening (31) could vary in shape in order to coincide with a differently shaped eye (11).

The housing (20) is an integral piece constructed of steel. However, other suitable materials with the requisite strength and durability could be used instead. Alternate materials could include nylon, plastic and other metals, such as aluminum, copper and brass.

The plurality of walls (25–29) form the housing (20) which covers a portion of the padlock (5) and hasp (10)

when the security cover (1) is installed. The interior region (23) of the housing (20) provides a protected area for containing the shackle (7) of the padlock (5) and a substantial portion of the hasp's eye (11).

The first opening (30) comprises means for providing access to the shackle. It provides limited access to the housing's interior region (23) through the first end (21) of the housing (20). A user can reach the shackle (7) of the padlock (5) when the padlock (5) is hooked on the eye (11) of the hasp (10). By extending a finger through the first opening (30), the user can manipulate the shackle (7) in order to facilitate locking the padlock (5).

Preferably, the amount of tolerance between the hasp (10), the security cover (1) and the padlock (5) is relatively small. Since the fit between the security cover (1), the hasp (10) and the padlock (5) is tight, it is advantageous for the user to be able to directly manipulate the shackle (7) through the first opening (30).

The second opening (31) comprises means for receiving the eye of a hasp into the housing. Through the second opening (31), the hasp (11) enters the interior region (23) of the housing (20). As previously mentioned, the tolerance between the second opening (31) and the eye (11) is preferably of a relatively small magnitude.

The third opening (32) comprises means for receiving the padlock into the interior region. This opening (32) allows entry of the padlock (5) into the interior region (23) of the housing (20). The padlock (5) is inserted through the third opening (32) and into the interior region (23) of the housing (20) in order to engage the shackle (7) with the eye (11) of the hasp (10).

Referring now to FIGS. 1 and 3, the first side wall (25) of the housing (20) is flanked by the second (26) and third (27) side walls, while the fourth side wall (28) is disposed opposite the first side wall (25). Similarly, the fourth side wall (28) is flanked by the second (26) and third (27) side walls. The second (26) and third (27) side walls are disposed opposite to each other and are each flanked by the first (25) and fourth (28) side walls.

The first (25), second (26), third (27) and fourth (28) side walls extend between the first (21) and second (22) ends of the housing (20). Each of the side walls (25–28) adjoin the end wall (29) at the first end (21) of the housing (20).

The first opening (30) is disposed in the end wall (29) at the first end (21) of the housing (20), while the third opening (32) is located at the second end (22) of the housing (20). At the second end (22) of the housing (20), the first (25), second (26), third (27) and fourth (28) side walls define the edges of the third opening (32). The second opening (31) is positioned on the fourth (28) side wall at a location closer to the second end (22) than the first end (21) of the housing (20). Furthermore, the second opening (31) is disposed nearer to the second side wall (26) than the third side wall (27). The first (25), second (26), and third (27) side walls are unperforated to limit access to the interior region (23).

In the preferred embodiment shown by FIGS. 3 and 4, the interior region (23) of the housing (20) is sized and proportioned to accommodate the cooperating padlock's size. The width ($w_h$) of the housing (20) is approximately equal to one and a half times the width ($w_{lb}$) of the lock body (6). The depth ($d_h$) of the housing (20) is equal to about twice the depth ($d_{lb}$) of the lock body (6), while the height ($h_h$) of the housing (20) is equal to about at least the height of the padlock ($h_{p/o}$) with the shackle (7) fully extended in its unlocked position or unlocked/opened position.

The first opening (30) preferably ranges in diameter from about ½ inch to about 1½ inches. It is sized to enable the user to insert a finger into the interior region (23) in order to facilitate closing and locking the padlock (5) by manipulating the shackle (7).

On the fourth side wall (28), the second opening (31) is sized to receive the eye (11) of a selected hasp (10). In a preferred embodiment, the tolerance of fit between the eye (11) and second opening (31) is relatively small.

The size of the third opening (32) is generally based on the size of the particular padlock used. Preferably, the third opening (32) has a width and depth that approximately corresponds to the width ($w_h$) and depth ($d_h$) of the housing (20).

In the preferred embodiment shown in FIG. 2, the second opening (31) receiving the hasp's eye (11) is disposed in the fourth wall (28). The top edge of the second opening (31) is spaced a first distance ($d_1$)from the end wall (29). The first distance ($d_1$) is greater than or equal to the height ($h_{s/o}$) of the shackle (7) when the padlock (5) is in the unlocked or unlocked/opened position. Furthermore, the top edge (33) of the second opening (31) is spaced a second distance ($d_2$) from the second end (22) of the housing (20) that is less than or equal to the height ($h_{s/l}$) of the shackle (7) when the padlock (5) is in the locked position on the hasp (10).

The end wall (29) is positioned opposite the third opening (27) and extends generally perpendicularly to the fourth side wall (28).

The first opening (30) is located on one side of the second opening (31) opposite the third opening (32) on the housing (20). This arrangement of the openings (30–32) provides access to the top of shackle (7) when installing the security cover (1). The first distance ($d_1$) between the first opening (30) and the second opening (31) is at most approximately the distance a user's finger can reach to touch the shackle (7) when the padlock (5) is hooked on the hasp's eye (11). The distance generally allows an average finger to be able to reach the shackle (7) through the first opening (30).

The third opening (32) is positioned on the second end (22) of the housing (20). It is spaced apart from the second opening (31) so that the housing (20) can contain a substantial portion and, preferably, all of the shackle (7) when the padlock is locked on the eye (11). When the padlock (5) is in the unlocked position on the hasp (10), the lock body (6) can extend outside the walls (25–29) of the housing (20) as shown in FIG. 4.

When installed on a hasp (10) with a padlock (5) as shown in FIGS. 1 and 2, the security cover (1) is positioned with the fourth side wall (28) of the housing (20) adjacent to the hasp (10). The housing (20) covers at least a portion of the hasp's securing piece (12). The eye (11) of the hasp (10) extends through the second opening (31) and into the interior region (23) of the housing (20). The padlock (5) is positioned in the third opening (32) and the shackle (7) engages the eye (11). When locked, the padlock (5) is partially contained within the interior region (23) and partially disposed outside of the housing (20).

To install the security cover (1) of the present invention on a hasp (10) with a padlock (5), the housing (20) is fitted onto the eye (11) of the hasp (10). The padlock (5) is inserted into the housing (20) and locked onto the eye (11). When so positioned and locked, the padlock (5) maintains the security cover (1) in place over the hasp (11) and padlock (5) itself.

Specifically, the hasp (10) is closed in a conventional method that is known in the art. The housing (20) is positioned with the fourth side wall (28) adjacent to the hasp (10)and the second opening (31) aligned over the eye (11). The housing (20) is moved towards the hasp (10) until the eye (11) is positioned in the housing's interior region (23). Once the eye (11) is inside of the housing (20), the shackle (7) of the padlock (5) is inserted through the third opening (32) and into the interior region (23). With the padlock (5) in the unlocked/opened position, the free end (8) of the shackle (7) is extended over and down through the eye (11). The padlock (5) is then locked by inserting a finger or other elongated object through the first opening (30) in the end wall (29) and pressing the shackle (7) towards the lock body (6), while simultaneously pressing the lock body (6) towards the free end (8) of the shackle (7) until the free end (8) engages the lock body (6). Once the padlock (5) is locked, the finger or object is removed from the housing (20).

To remove the security cover (1) from the hasp (10), the padlock (5) is unlocked by means known in the art. The shackle (7) is pivoted to the unlocked/opened position and removed from the eye (11) of the hasp (10) by lifting its free end (8) out of the eye (11). The padlock (5) is then removed from the housing (20) and the housing (20) can be slipped off the eye (11) of the hasp (10).

The security cover of the present invention significantly inhibits vandalism and increases the security of a padlock and hasp. The housing denies access to the shackle of the padlock and the eye of the hasp, thereby deterring vandals from cutting through the shackle or eye in order to free the hasp.

With the first opening allowing a user limited access to the housing's interior region, the security cover is easy to install. The limited access enables a user to directly manipulate the shackle to facilitate locking the padlock, but inhibits the insertion of cutting tools into the housing. The latter reduces the risk of damage to the padlock or hasp.

Furthermore, the third opening also allows easy installation of the security cover with a hasp and padlock. The size and position of the third opening also deter cutting tools from accessing the interior region of the housing, thereby reducing the opportunity for vandalism.

It is preferred that the amount of tolerance between the housing, the padlock and the hasp be relatively small. The tighter the tolerances are between the housing, padlock and hasp, the less the movement is that will occur between the elements, and the more effective the security cover can be to protect the padlock and hasp.

In one example as shown in the figures, the padlock (5) used with a preferred embodiment of the invention is a conventional size. The dimensions of the padlock include a lock body with width ($w_{lb}$), height ($h_{lb}$), and depth ($d_{lb}$) that are approximately 1⅞ inches, 1½ inches, and 1 inch, respectively. The shackle has a diameter of approximately ⅝ inches. When the padlock is in a locked position, the shackle extends out from the lock body a distance of about 1⅛ inches. Alternately, when the padlock is in the unlocked or unlocked/opened position, the shackle extends a distance of about 1⅝ inches out from the lock body.

Preferably, the housing has a height of about 3½ inches, a width of about 3 inches and a depth of about 1¾ inches. The first opening is centered in the end wall and has a diameter of approximately 1 inch. The first distance ($d_1$) from the first end to the top of the second opening is approximately 2⅛ inches, while the second distance is approximately 1⅜ inches. The walls of the housing have a thickness of about ⅛ inches.

Figure 5:
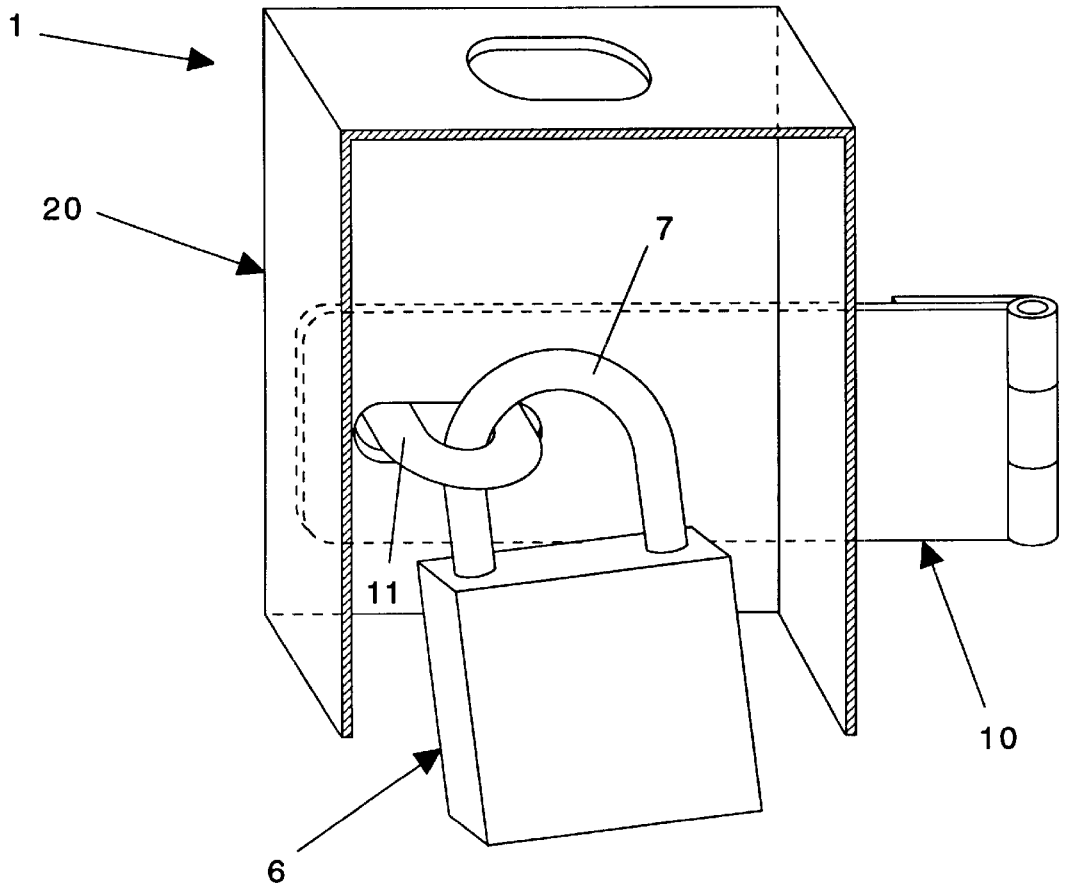
FIG. 5 is a partial front perspective view of the security cover of FIG. 1 with the first side wall removed in which the security cover is shown with an alternate hasp arrangement and padlock.

It should be appreciated that the security cover of the present invention is not limited to use with the hasp disclosed herein, but could also be used with other types of hasp arrangements. One example is shown in FIG. 5, wherein the eye of the hasp extends perpendicularly to the hasp shown in FIG. 1. The second opening of the housing fits over the eye in much the same manner as disclosed previously herein. However, in this alternate example the hasp extends laterally across the fourth side wall.

It should be also appreciated that the security cover herein disclosed is not limited to use with a hasp, but could be used with other types of closure hardware having a locking element such as the eye that is capable of engaging the second opening of the housing.

Although the present invention has been described in considerable detail with reference to certain preferred versions thereof, other versions are possible. Therefore, the spirit and scope of the appended claims should not be limited to the description of the preferred versions contained herein.

What is claimed is:

1. A security cover comprises:

a housing with an interior region; and a plurality of openings;

said housing further comprises first and second ends, first, second, third and fourth side walls, and at least one end wall;

said plurality of openings comprises first, second and third openings;

wherein said fourth side wall is disposed adjacent to said second and third side walls and is further disposed opposite to said first side wall, said first opening is disposed in said at least one end wall, said second opening is disposed in said at least one side wall, said third opening is disposed opposite the first opening, said at least one end wall is disposed on said first end, said third opening is disposed on said second end, said second opening is disposed nearer to said second side wall than said third side wall, and said second opening is located nearer to said second end than to said first end of the housing.

2. The security cover of claim 1, wherein said second opening is an elongated slot.

3. The security cover of claim 1, wherein said first, second and third side walls are unperforated.

4. A security cover attached to a hasp by a padlock, wherein said hasp comprises a securing piece and an eye that cooperates with said securing piece, said padlock comprises a lock body and a shackle which releasably engages the eye of the hasp, said security covering comprising:

a housing having a first and second end, at least one side wall, at least one end wall and an interior region; and first, second and third openings;

wherein said first opening is disposed on said at least one end wall and provides limited access to the shackle, said second opening receives the eye therein, said third opening receives the padlock therein, the shackle engages the eye of the hasp; said second opening is disposed on said at least one side wall, said third opening is disposed on said second end, and said second opening is located nearer to said third opening than to said first opening.

5. The security cover of claim 4, wherein said at least one side wall comprises a plurality of side walls.

6. The security cover of claim 5, wherein said plurality of side walls includes first, second, third and fourth side walls, and said second opening is disposed in said fourth side wall.

7. The security cover claim 6, wherein said fourth side wall is disposed adjacent to said second and third side walls and is further disposed opposite to said first side wall, and said second opening is disposed nearer to said second side wall than said third side wall.

8. The security cover of claim 6, wherein said first, second and third side walls are unperforated.

9. A security cover attached to a hasp by a padlock, wherein said hasp comprises a securing piece and an eye that cooperates with said securing piece, said padlock comprises a lock body and a shackle which releasably engages the eye of the hasp, said security cover comprising:

a housing having first, second, third and fourth side walls, and an interior region surrounded by said side walls; and first, second and third openings, wherein said first opening provides access to close the shackle, the second opening receives the eye therein, the third opening receives the padlock therein with said shackle engaging said eye, said fourth side wall is disposed adjacent to said second and third side walls and is further disposed opposite to said first side wall, said second opening is disposed in said fourth side wall, and said second opening is located nearer to said second side wall than to said third side wall.

10. The security cover of claim 9, wherein said first, second and third side walls are unperforated.

* * * * *

UNITED STATES PATENT AND TRADEMARK OFFICE

CERTIFICATE OF CORRECTION

PATENT NO. : 6,578,393 B2
DATED : June 17, 2003
INVENTOR(S) : Doyle Yarborough

It is certified that error appears in the above-identified patent and that said Letters Patent is hereby corrected as shown below:

Title page,
Item [12] and [76], Inventor's, name, change "Yarborought" to -- Yarborough --.

Signed and Sealed this

Ninth Day of September, 2003

JAMES E. ROGAN
*Director of the United States Patent and Trademark Office*